United States Patent [19]

Stratmann et al.

[11] 4,379,023

[45] Apr. 5, 1983

[54] CHARGING HOLE LOCK FOR HORIZONTAL COKE OVENS

[75] Inventors: Josef Stratmann, Recklinghausen; Willi Brinkmann, Herne, both of Fed. Rep. of Germany

[73] Assignee: Firma Carl Still GmbH & Co. KG, Fed. Rep. of Germany

[21] Appl. No.: 353,908

[22] Filed: Mar. 1, 1982

[30] Foreign Application Priority Data

Mar. 6, 1981 [DE] Fed. Rep. of Germany ..... 3108483

[51] Int. Cl.[3] ..... C10B 25/24; C10B 31/04

[52] U.S. Cl. ..... 202/247; 202/251; 202/262; 202/269; 414/200

[58] Field of Search ..... 202/247, 248, 250, 251, 202/262, 269; 414/200; 110/116; 266/271

[56] References Cited

U.S. PATENT DOCUMENTS

| | | | |
|---|---|---|---|
| 1,933,729 | 11/1933 | Goetz | 202/251 |
| 3,198,623 | 8/1965 | Evans et al. | 414/200 |
| 3,945,515 | 3/1976 | Busbach | 202/262 |
| 4,211,611 | 7/1980 | Bocsanczy et al. | 202/262 |
| 4,242,027 | 12/1980 | Stratmann et al. | 202/262 |
| 4,296,938 | 10/1981 | Offermann et al. | 202/269 |

*Primary Examiner*—Bradley Garris

*Attorney, Agent, or Firm*—McGlew and Tuttle

[57] ABSTRACT

A lock is disclosed for charging holes of horizontal coke ovens and for permitting the charging of moist or preheated coal through charging devices, such as longitudinal conveyors fixedly mounted on the battery, or traveling charging cars, while preventing emission. The lock is designed as a spectacle gate accommodated in a casing which is firmly connected to the frame of the charging hole and forms a gastight seal against the connections of the charging devices even during the actuation of the spectacle gate, and with the spectacle gate being actuated through a linkage from outside the casing.

9 Claims, 6 Drawing Figures

CHARGING HOLE LOCK FOR HORIZONTAL COKE OVENS

FIELD AND BACKGROUND OF THE INVENTION

The present invention relates in general to horizontal coke ovens and in particular to a new and useful charging hole lock which substantially eliminates undesirable emissions from the coke oven.

The present invention is aimed at preventing charging gases from escaping during the operation of charging a coke oven chamber, particularly during the removal and putting in place of a charging hole plug, and during the sealing of the charging holes during the entire coking period.

Prior art locks comprise, almost without exception, a simple charging hole cover which is loosely placed on the frame of the charging hole or in a recess thereof.

At the start of a charging operation, such a charging hole cover is lifted and, for example, pivoted sidewards, to clear the space for the placement of charging funnels or transfer members. Upon terminating the charging operation, the transfer members are lifted and the charging hole cover is returned to its place.

To eliminate emissions, particularly during the interval between the end of charging and the instant of closing the charging holes, it is known to remove the charging hole covers and put them in place again, within an enclosing hood which is lowered onto the oven prior to starting the charging operation, thus within a closed system (German OS Nos. 28 04 935; 28 04 825 and 23 36 514). In all such designs, problems arise during the lifting and lowering of such covers, primarily if dirt and tar have deposited on the inside of the hood. In such instances and if a magnetic lifting is provided, the cover easily becomes disengaged or canted. This results in problems developing for the charging operation and subsequently when putting the cover in place.

Therefore, if the charging holes are to be cleaned prior to the charging operation, not only the cover but also the hoods must be completely removed.

In an arrangement for controlled charging, particularly of preheated coal from lengthwise conveyors through side chutes, it has been provided, as disclosed in German OS No. 23 365 14 to lower into the hood, a telescopic charging tube which is sealed relative to another charging tube. Again, experience has shown that deposited dirt prevents the telescopic parts from moving relative to each other within a short time.

SUMMARY OF THE INVENTION

The present invention is directed to a gastight charging hole lock which is free from the above mentioned problems with charging covers and telescoping parts and ensures a charging operation without emission.

Accordingly, an object of the present invention is to provide a charging hole lock for a horizontal coke oven having a charging hole and chargeable with moist or preheated coal through a charging member, comprising, a charging hole frame inserted into the charging hole, the frame having an opening aligned with the charging hole, a casing connected over and sealed to the frame and defining a guideway space therewith, a spectacle gate having a gate opening and a plug portion slidably mounted in the space for movement into an open position with the gate opening aligned with the frame opening, and a closed position with the plug portion aligned with the frame opening, a linkage connected to the spectacle gate for moving the spectacle gate and means on the casing for connecting the casing, in a gastight fashion, to the charging member.

Another object of the invention is to provide the frame with a laterally elongated supporting plate portion extending in a direction of motion of the gate for accommodating the gate.

A still further object of the invention is to provide such a charging hole lock wherein metallic gaskets are included between the casing and the gate for sealing the gate opening to the frame hole in the gate open position.

Another object of the invention is to provide such a device wherein the charging member extends vertically upwardly of the casing, including an upper cover which is openable to provide access to the frame, charge hole and gate openings.

A still further object of the invention is to provide the device with such a charging chute and upper cover which includes a water seal for sealing the chute with the upper cover in a closed position.

Another object of the invention is to provide a hinged plate in the chute with a counterweight for permitting the passage of hot coal into the charging hole and automatically closing the chute when a flow of coal ceases.

A still further object of the invention is to provide a chute hole lock with spectacle gate which is simple in design, rugged in construction and economical to manufacture.

The advantage of this inventive structure is that in connection with a longitudinal conveyor, such as a chain conveyor, which is fixedly set up on the roof of the battery, a closed charging system is obtained which is tight not only during the charging operation proper, but also during the connection and disconnection of the charging mechanism, so that the environmental nuisance of thick smoke, dust, and heat emission, is avoided. For arrangements where a charging car carrying moist or preheated coal and traveling on the roof is employed instead of a longitudinal conveyor, the inventive device makes it possible to seal the zone between the car and the hole during the charging operation and even to establish a sealing connection between the telescoping parts and the charging hole while the oven is still closed, and to make it effective after engaging the parts into the hole. The same procedure, in reversed order, after the charging, makes it possible to close the hole prior to disengaging the sealing connection.

In the inventive spectacle gate, which is advantageously designed as a block gate, there is no need for an accurate alignment of a cover-removing device with the cover, nor for a complicated centering of the cover to put it back in place in its frame. In accordance with the invention, the spectacle gate associated with each of the charging holes is actuated manually, or mechanically through a special actuator. If a charging car is employed, such an actuator may be provided on the car.

With stationary longitudinal conveyors, the actuator for moving the spectacle gate may even be fixed on the roof of the oven battery. A metallic sealing ring or gasket has proved suitable as the means for sealing a spectacle gate relative to the upper casing and the lower supporting frame, by which deposits which might have formed are stripped away upon an actuation of the spectacle gate. This is a kind of automatic cleaning of the spectacle gate in its guideway.

Should the arrangement be such that the coal is charged by stationary longitudinal conveyors provided on the battery, through chutes and charging connections which are known per se, it is advantageous to fix the charging connections to the casing of the spectacle gate. The inventive water seal at the upper cover of the charging connection is particularly gastight and can easily be opened or closed for checking the charging holes.

For charging preheated coal which is particularly fluid, it is advisable to provide a hinged plate in the charging chute, adjacent the inlet of the charging connection, by which the coal flow is controlled. In accordance with the invention, the hinged axis of the plate is horizontal and the hinge pin extends through the casing to the outside where it is equipped with an adjustable counterweight. With a decreasing coal flow, the plate is thus pushed back into the chute and charging gases are prevented from escaping from the charging holes through the chute to the longitudinal conveyor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
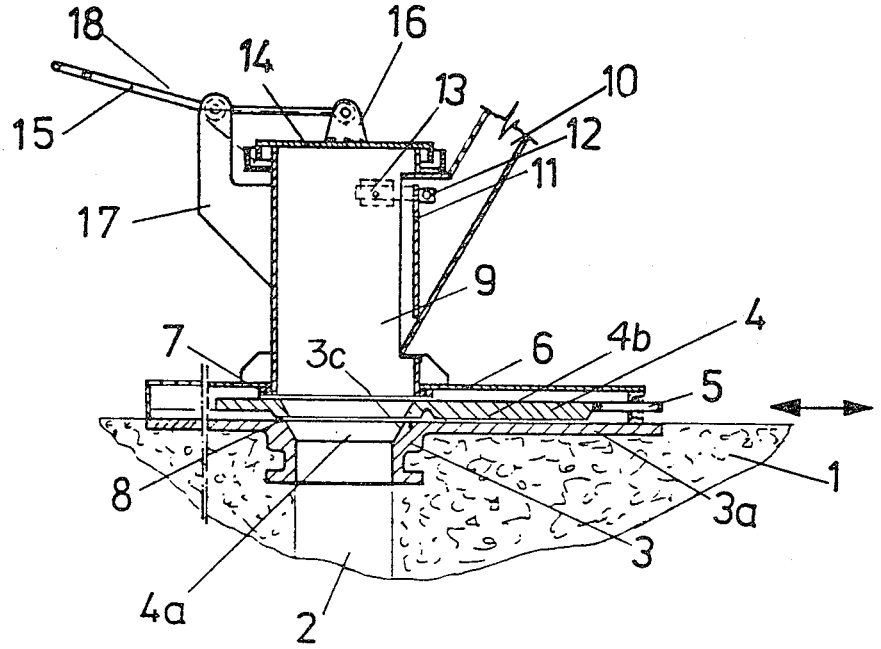
FIG. 1 is a longitudinal sectional view taken along the line 1—1 of FIG. 2 of a charging hole lock according to the invention used with a fixed structure connecting the lock to a longitudinal conveyor.

Referring to the drawings in particular, the invention embodied therein, in FIG. 1 comprises a charging hole lock for facilitating emission free charging of a charging hole 2 of a horizontal coke oven 1 utilizing a frame 3 fixed to the coke oven, a casing 6 which forms a gastight seal with the frame 2 and defines a guideway space therein, and a spectacle gate 4 which is movable between an open and a closed position.

To facilitate the understanding of the figures, wherein similar reference numerals are used to designate similar parts throughout, the reference numerals with designated part are here listed:

1—oven roof;
2—charging hole;
3—frame of charging hole;
**3*a***—lateral extension of charging hole frame;
**3*b*—screws for securing housing 6**;
**3*c***—charging frame hole;
4—spectacle gate;
**4*a***—gate opening;
**4*b***—closing plug;
5—actuating link for spectacle gate;
6—casing of spectacle gate;
7—upper gasket;
8—lower gasket;
9—charging connection;
10—charging chute;
11—hinged plate;
12—horizontal hinge pin of hinged plate;
13—counterweight for hinged plate;
14—upper cover;
15—actuating link for upper cover;
16—support;
17—bracket;
18—water seal; and
19—telescopic connection of the charging car outlet.

The figures show the spectacle gate 4 in the open position, in which a circular or rectangular gate opening **4*a* surrounded by a ring formation is aligned with the charging hole 3*a* while the plug proper 4*b* of spectacle gate 4 is located laterally thereof and within a casing 6. The ring surrounding gate opening 4*a* is sufficiently high to provide, along with metallic gaskets 7, 8, a gastight seal in the space between the frame 3 of the charging hole and casing 6, a charging connection 9, or a telescopic connection 19 of the charging car outlet. To close charging frame hole 3*c* and charging hole 2, spectacle gate 4 is shifted, through an actuating linkage 5 which extends through an opening in the casing, from the right to the left according to FIG. 1, until closing plug 4*b*** is aligned with the charging hole.

Figure 2:
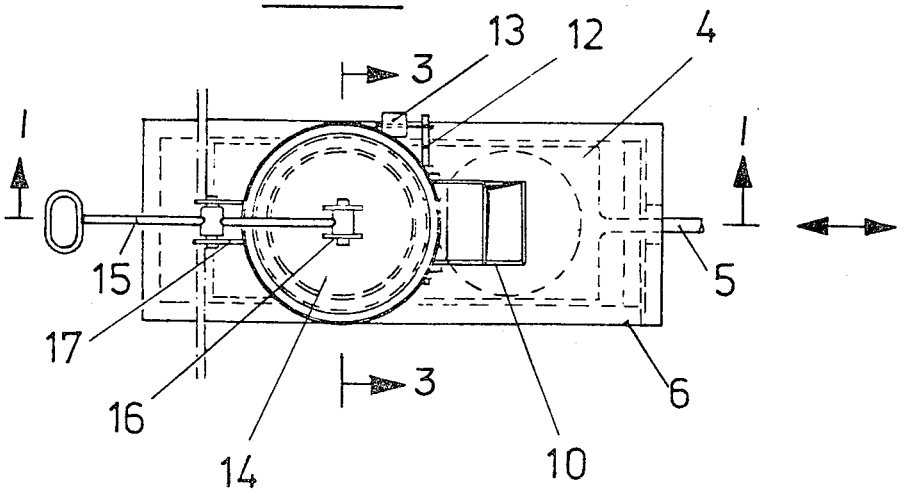
FIG. 2 is a top plan view of the device in FIG. 1.
Figure 3:
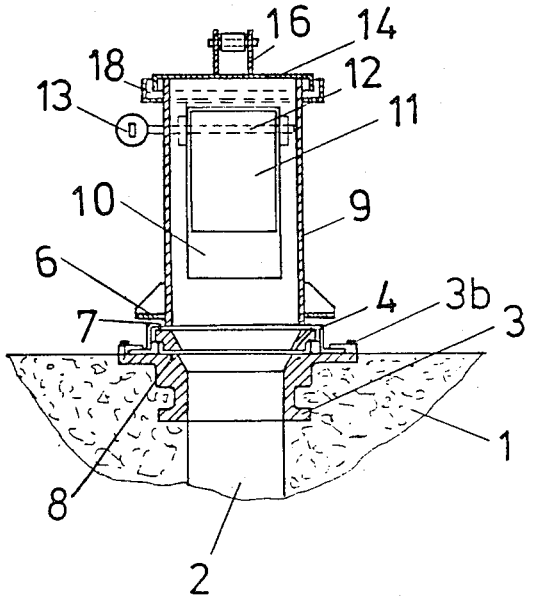
FIG. 3 is a sectional view taken along the line 3—3 of FIG. 2.

If a fixed connection in accordance with FIGS. 1 to 3 is provided, and frame 3 of the charging frame hole **3*c* and charging hole 2 are to be cleaned prior to charging the oven, only the upper cover 14 is pivoted upwardly, manually by means of an actuating linkage 15, so that with the spectacle gate being open, any cleaning device may be lowered to the charging holes. Unlike in prior art locks, no hinged plates or charging hole covers nor any charging tubes hinder the introduction of cleaning devices through charging connection 9 and casing 6**.

In addition, a construction which is relatively light in weight may be provided for cover 14, since the sealing is not obtained by the weight of this cover alone.

Figure 5:
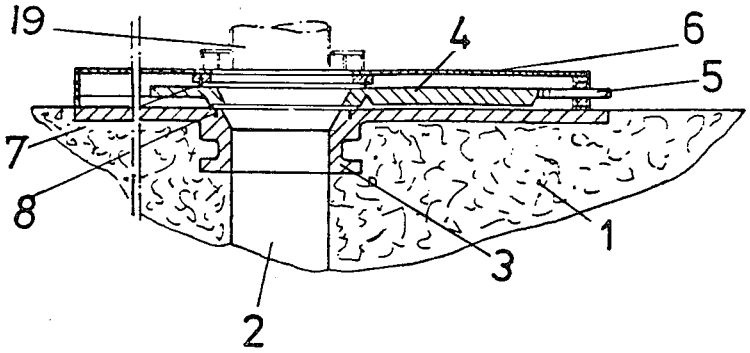
FIG. 5 is a longitudinal sectional view taken along the line 5—5 of FIG. 4 of another embodiment of the invention wherein a direct connection is made to the lock.
Figure 4:
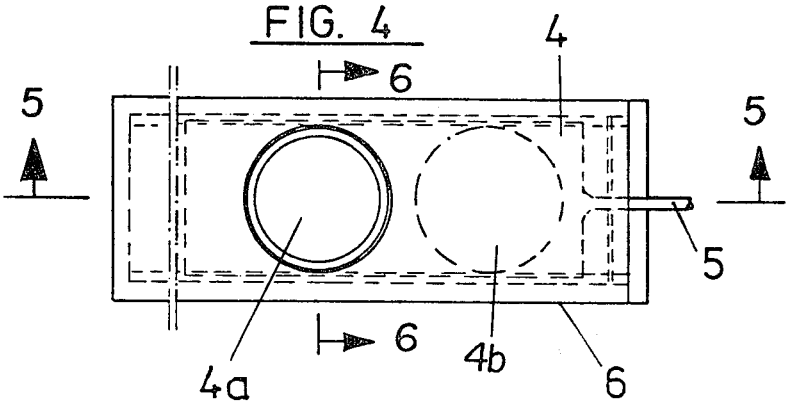
FIG. 4 is a top plan view of the device shown in FIGS. 5 and 6.
Figure 6:
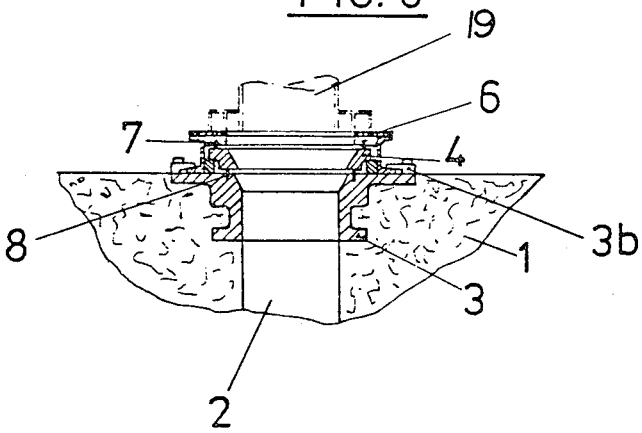
FIG. 6 is a sectional view taken along the line 6—6 of FIG. 4.

Referring to the embodiment of FIGS. 4, 5 and 6, the charging member in the form of charging connection or chute 9, is replaced by a telescopic connection 19 of a charging car (not shown). Means are provided on the casing 6 for establishing a gastight seal with the telescopic connection 19.

In the embodiment of FIGS. 1, 2 and 3, the connecting member 9 including the chute 10 is also provided with a hinged plate 11 having a horizontal hinge pin 12 which extends outwardly of the chute 10 and includes a counterweight 13. In this way, where fluid hot coal is provided to the chute 10, the flow automatically opens the hinged plate 11. When the flow reduces or ceases, the hinge plate 11 closes automatically to prevent undesired emissions.

The upper cover 14 is provided with a support 16, and the connecting member 9, a support 17 for pivotally receiving the actuator 15. Water seal 18 is provided for establishing a gastight seal with the cover 14 in its closed position.

While specific embodiments of the invention have been shown and described in detail to illustrate the application of the principles of the invention, it will be understood that the invention may be embodied otherwise without departing from such principles.

What is claimed is:

1. In combination, a horizontal coke oven having a charging hole, a charging hole lock and a charging member, comprising:

a charging hole frame inserted into the charging hole, said frame having an opening aligned with the charging hole;

a casing connected over and sealed to said frame in a gastight fashion to define a gateway space therewith;

a spectacle gate having a gate opening and a plug portion, slidably mounted in said space for movement into an open position with said gate opening aligned with said frame opening, and a closed position with said plug portion aligned with said frame opening;

a linkage connected to said spectacle gate for moving said spectacle gate; and seal means provided on said casing for establishing a gastight seal with the charging member.

2. The combination according to claim 1, wherein said casing includes an opening therethrough, said linkage extending through said opening.

3. The combination according to claim 1, wherein said charging hole frame includes a supporting plate portion extending laterally in a direction of motion of said gate for receiving and accommodating the motion of said gate.

4. The combination according to claim 1, including a metallic gasket between said spectacle gate around said gate opening and said casing and charging hole frame respectively.

5. The combination according to claim 1, wherein the charging member comprises a connecting portion fixed to said casing in a gastight manner, and a charging chute extending into said connecting portion, said charging hole lock including an upper cover movable to expose an upper opening of said connecting portion for providing access to said gate opening, said frame opening and the charging hole, said means comprising the fixed gastight connection between said connecting portion and said casing.

6. The combination according to claim 5, including a water seal connected near the top of said connecting portion for receiving said upper cover and establishing a gastight seal between said upper cover and said connecting portion.

7. The combination according to claim 6, wherein said upper cover is hingedly connected to said connecting portion.

8. The combination according to claim 6, including a hinged plate hingedly mounted to said charging chute and movable to close and open said charging chute to permit a flow of hot coal therethrough and into said charging hole with said spectacle gate in its open position.

9. The combination according to claim 8, including a horizontally extending hinge pin connected to said hinged plate and charging chute for hingedly mounting said hinged plate, and an adjustable counterweight connected to said pin and extending therefrom for automatically moving said hinged plate into a closed position with the absence of hot coal flow in said charging chute.

* * * * *